US005676609A

United States Patent [19]

Møllebaek

[11] Patent Number: 5,676,609

[45] Date of Patent: Oct. 14, 1997

[54] COMPOSITE BALL BATS

[76] Inventor: Troels Møllebaek, P.O. Box 9 5854, Gislev, Denmark

[21] Appl. No.: 633,119

[22] Filed: Apr. 16, 1996

[51] Int. Cl.[6] ..... A63B 69/40

[52] U.S. Cl. ..... 473/564

[58] Field of Search ..... 273/26 B, 72 R, 273/72 A; 473/520, 564–568

[56] References Cited

U.S. PATENT DOCUMENTS

| | | | |
|---|---|---|---|
| 59,313 | 10/1866 | Hill | 273/72 R |
| 610,262 | 9/1898 | Dikeman | 273/72 A |
| 1,603,904 | 10/1926 | Cohn . | |
| 1,611,858 | 12/1926 | Middlekoff | 273/72 R |
| 1,665,195 | 4/1928 | Cohn . | |
| 2,169,774 | 8/1939 | Taylor | 273/72 |
| 2,195,681 | 4/1940 | Robarge | 273/72 |
| 3,618,945 | 11/1971 | Kucher | 273/26 B |
| 4,871,168 | 10/1989 | Autorino | 273/72 R |
| 5,364,095 | 11/1994 | Easton | 273/72 N |
| 5,409,214 | 4/1995 | Cook | 273/72 |
| 5,511,777 | 4/1996 | McNeely | 273/72 A |

FOREIGN PATENT DOCUMENTS

| | | | |
|---|---|---|---|
| 49303 | 3/1993 | Japan | 273/72 A |

*Primary Examiner*—Theatrice Brown
*Attorney, Agent, or Firm*—Hughes, Multer & Schacht

[57] ABSTRACT

Ball bats of composite construction. These bats have a wooden handle and barrel and a metal sleeve which surrounds the barrel. The interaction between the sleeve and barrel keeps a batter's hands from being stung and/or the bat from being broken when a ball is struck.

4 Claims, 2 Drawing Sheets

COMPOSITE BALL BATS

TECHNICAL FIELD OF THE INVENTION

The present invention relates to novel, improved ball bats of composite construction.

DEFINITION

As employed herein, the term "ball bat" is intended to include but not be limited to baseball bats and softball bats.

BACKGROUND OF THE APPLICATION

Traditionally, baseball, softball, and other ball bats have been fabricated from a piece of solid wood, typically ash. This construction has been supplanted to some extent by ball bats extruded from aluminum alloys. However the extent to which metal bats have, and may, supplement wooden bats is limited because of the inability of metal bats to meet weight and performance standards and because of the continuing aesthetic appeal of wooden bats and the preference for the sound of a wooden bat striking a ball.

Wooden bats have an elongated handle which is gripped by the batter and an integral, axially aligned barrel. It is the barrel of the bat with which the batter tries to strike a ball because a ball can thereby be hit harder and at least to some extent along a path selected by the batter. Each bat has a "sweet spot" located along its barrel. This is the optimal place to hit the ball.

If the ball is not met by the sweet spot on the bat and, even more disadvantageously, is instead met by the handle of the bat, vibrations capable of severely stinging the batter's hands may be set up in the bat. This sensation can be so severe as to influence the batter's future hitting ability by causing the batter to flinch.

Furthermore, balls which are struck other than on the sweet spot of the bat may result in the bat being broken. Broken bats pose a threat of injury to others on or near the playing field, and the expense of replacing broken bats can be significant.

SUMMARY OF THE INVENTION

There have now been invented, and disclosed herein, certain new and novel ball bats in which the foregoing problems—especially that of a ball and bat impact stinging the batter's hands—have been significantly reduced, if not entirely eliminated. In general, this is accomplished by surrounding the barrel of the bat with a metallic, typically aluminum alloy tube. The resulting composite (wood and metal) barrel of the bat minimizes the vibrations attributable to impact of a ball on the bat. The result is the elimination or at worst significant reduction in the stinging sensations experienced by the batter as well as vibrational patterns which may result in the bat breaking.

This novel approach to the elimination of vibrations in impacted ball bats also has the advantage that the weight and weight distribution of a bat can readily be changed, as needed, by increasing and decreasing the thickness of the barrel surrounding sleeve and/or by removing material from the wooden part of the barrel. Furthermore, ball bats employing the principles of the present invention have the advantage that the surface of the metallic barrel component can easily and inexpensively be treated to optimize the friction between the bat and a ball being struck. A variety of surface treatments can be employed. For example, the surface of the tubular component can be polished, glass bead-blasted, or sandblasted.

The important objects, features, and advantages of the invention will be apparent to the reader from the foregoing, the appended claims, and the ensuing detailed description and discussion of the invention taken in conjunction with the accompanying drawings.

DETAILED DESCRIPTION OF THE INVENTION

Figure 1:
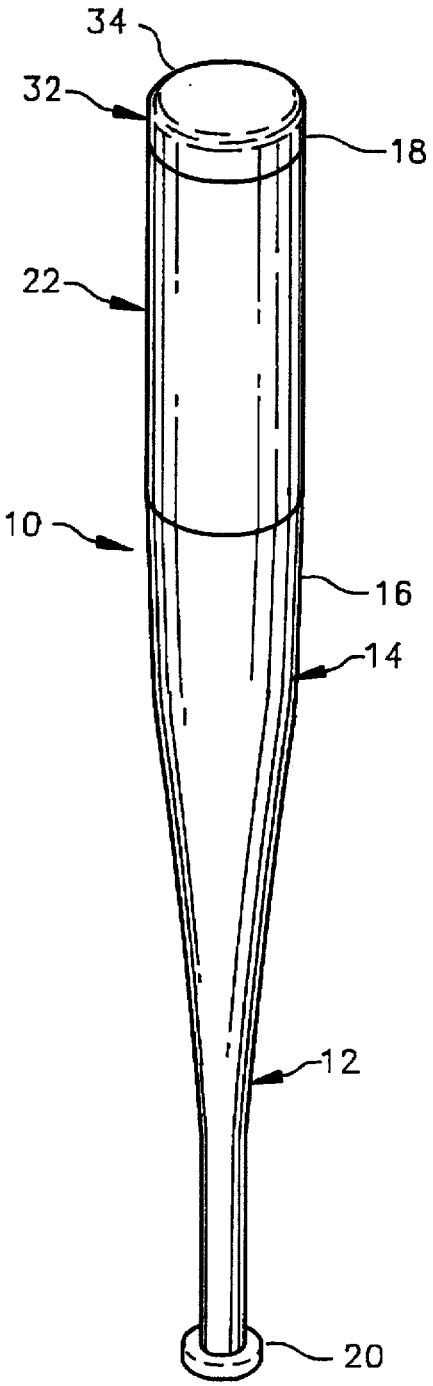
FIG. 1 is a perspective view of a baseball bat embodying the principles of the present invention.
Figure 2:
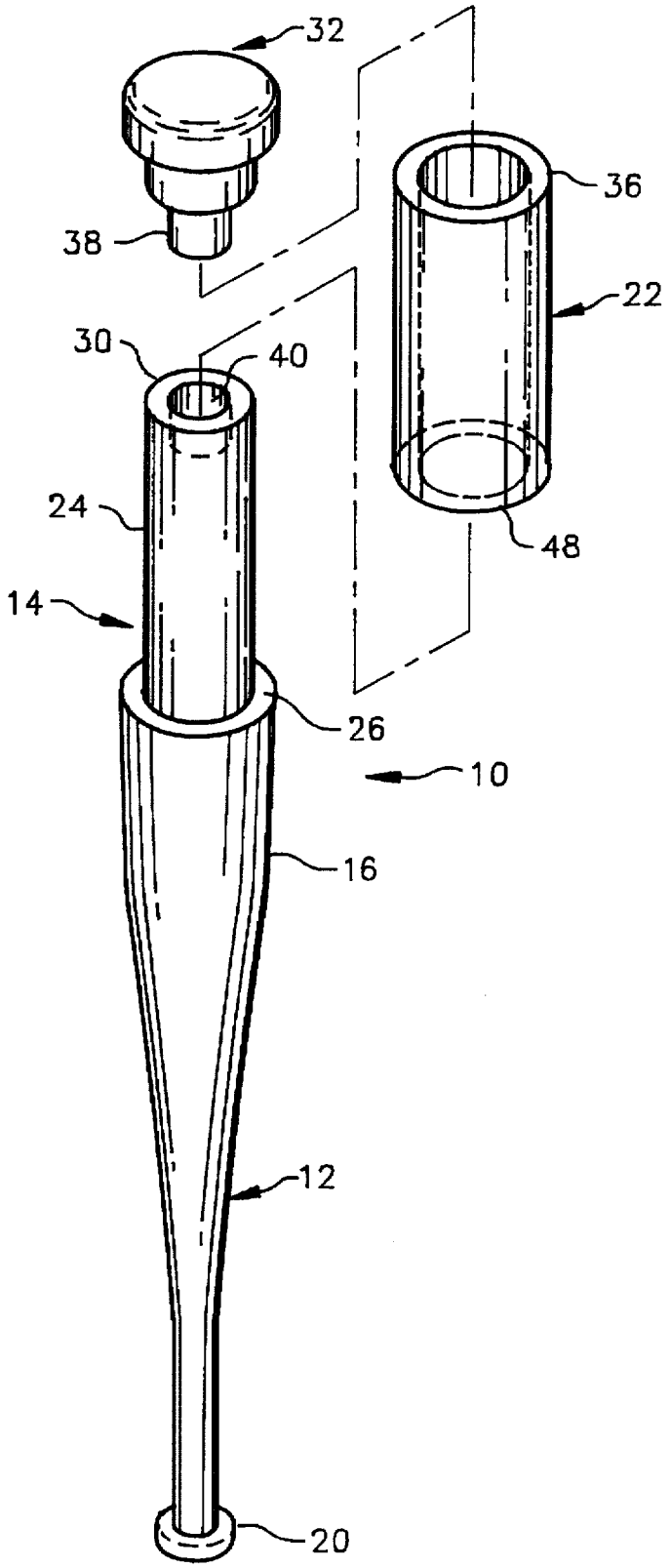
FIG. 2 is an exploded view of the FIG. 1 bat.

Referring now to the drawings, reference character 10 identifies a baseball bat embodying, and constructed in accord with, the principles of the present invention. Bat 10, fabricated for the most part from a solid piece of ash or other appropriate wood, has an elongated handle 12 and an integral barrel 14. Handle 12, configured to be gripped by a batter, tapers smoothly into barrel 14 at the proximate end 16 of the barrel. Barrel 14 has a generally uniform cross section over its length from proximate end 16 to distal end 18.

Bat 10 also has an integral knob 20 at the end of handle 12 opposite barrel 14. Knob 20 is conventional and keeps the batter's hands from sliding off the handle when bat 10 is swung.

In accord with the principles of the present invention, at least a major part of the barrel 14 of bat 10 is surrounded by a (typically) aluminum alloy sleeve 22. That sleeve acts in concert with the wooden barrel 14 of bat 10 to minimize unwanted vibrations set up when a ball is struck. This minimizes, if it does not entirely eliminate, the batter's hands being stung. In addition, the possibility that the batter may flinch in anticipation of the same unpleasant sensation during a subsequent turn at bat is avoided.

Also, by virtue of its interaction with barrel 14, sleeve 22 has the potential of reducing the incidence of broken bats when a ball is struck by other than the sweet spot on barrel 14.

The barrel 14 of bat 10 has a reduced diameter section 24 which terminates at its proximate end in an annular, sleeve-engageable ledge 26. Sleeve 22 tightly surrounds reduced diameter barrel section 24 and protrudes beyond the distal end 30 of that section.

The sleeve component 22 of barrel 14 is trapped against ledge 26 by a plug-type retainer 32 which also serves as the distal end of bat 10. Plug 32 has an annular ledge 35 which engages the distal end 36 of sleeve 22 when bat 10 which is assembled. Sleeve 22 is consequently trapped between ledge 35 and the ledge or seat 26 at the proximate end of reduced diameter barrel section 24.

Plug 32 also has a longitudinally extending, integral, boss 38. That plug segment or component is seated in a recess 40 which is centered on the axial centerline 42 of bat 10. Recess 40 opens onto the distal end 30 of reduced diameter barrel 14 section. An annular step 44 on plug 32 engages the distal end 30 of reduced diameter barrel section 24 when plug 32 is installed.

Any appropriate adhesive may be employed to retain plug 32 in place.

Figure 3:
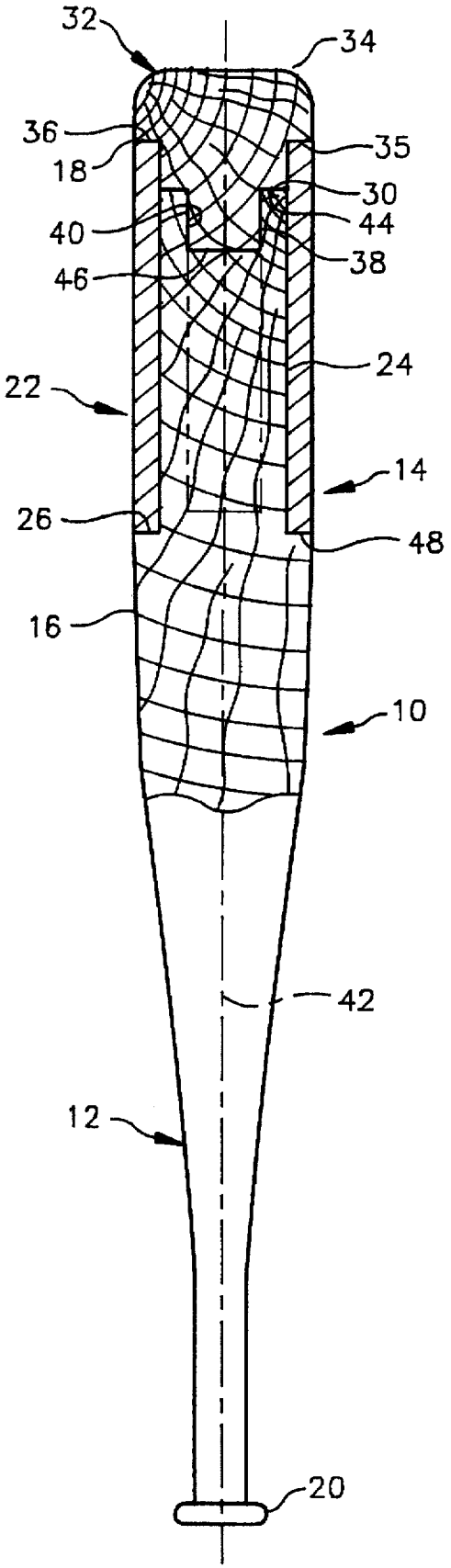
FIG. 3 is a partially sectioned side view of the bat.

As shown in phantom lines in FIG. 3, the recess 40 in reduced diameter barrel section 24 may be continued beyond the exposed end 46 of plug 32. This is done to remove material from bat 10 and thereby reduce its weight.

As is best shown in FIGS. 1 and 3 sleeve 22 and plug 32 of bat 10 are dimensioned to smoothly continue the contour of barrel 14. This desirable feature is promoted by making sleeve 22 with ends 36 and 48 of the same external dimensions and configurations as the ledges 35 and 26 of plug 32 and barrel 14 which those ends of sleeve 22 engage.

The invention may be embodied in many forms without departing from the spirit or essential characteristics of the invention. The present embodiment is therefore to be considered in all respects as illustrative and not restrictive, the scope of the invention being indicated by the appended claims rather than by the foregoing description. All changes which come within the meaning and range of equivalency of the claims are therefore intended to be embraced therein.

What is claimed is:

1. A composite ball bat which comprises:

a solid wooden elongated barrel with a reduced diameter section;

a handle longitudinally aligned and integral with said barrel;

a metallic sleeve surrounding said reduced diameter barrel section to form a preferred ball hitting area, said sleeve being configured to smoothly continue the eternal contour of said barrel; and a retainer means, said retainer means being installed in the distal end of the barrel and being configured to engage said sleeve and hold the sleeve in place on the reduced diameter barrel section of the bat wherein said solid wooden elongated barrel and said metallic sleeve function to dampen vibrations in the composite ball bat when the composite ball bat is struck by a ball.

2. A composite ball bat as defined in claim 1 in which there is a first annular ledge at the proximate end of the reduced diameter barrel section and a second, complementary annular ledge on said retainer means, said metallic sleeve being trapped between said first and second ledges with opposite, first and second ends of said sleeve engaging said ledges.

3. A composite ball bat as defined in claim 2 in which the contours of said sleeve at the first and second ends thereof respectively match the contours of said first and second ledges.

4. A composite ball bat as defined in claim 1 in which:

there is a recess in said barrel that opens onto the distal end of the barrel and is centered on the longitudinal centerline of the bat; and said retainer means has an integral plug which is seated in said recess with an annular step at a retainer means integrated end of said plug engaging the distal end of the reduced diameter barrel section of the bat.

* * * * *